US006310330B1

(12) United States Patent
Stevanovic et al.

(10) Patent No.: US 6,310,330 B1
(45) Date of Patent: Oct. 30, 2001

(54) HVAC HEATER POWER AND CONTROL CIRCUIT

(75) Inventors: Ljubisa Dragoljub Stevanovic, Niskayuna; Ahmed Elasser, Latham, both of NY (US); Thomas Bernard Breen, Broomall; Wayne William Mihailov, Downingtown, both of PA (US); Rollie Richard Herzog, Louisville, KY (US)

(73) Assignee: Transport International Pool, Inc., Devon, PA (US)

( * ) Notice: Subject to any disclaimer, the term of this patent is extended or adjusted under 35 U.S.C. 154(b) by 0 days.

(21) Appl. No.: 09/547,459

(22) Filed: Apr. 12, 2000

(51) Int. Cl.[7] ..... H05B 1/02

(52) U.S. Cl. ..... 219/494; 219/483; 219/486; 219/510; 219/493; 307/41; 337/42

(58) Field of Search ..... 219/501, 505, 219/483–486, 508–511, 491, 493, 490; 307/39–41; 337/102, 41, 42

(56) References Cited

U.S. PATENT DOCUMENTS 3,046,380 * 7/1962 Carlson ..... 219/20
3,606,970 * 9/1971 Kompelien ..... 236/11

* cited by examiner

*Primary Examiner*—Mark Paschall
(74) *Attorney, Agent, or Firm*—Jill M. Breedlove; Douglas E. Stoner

(57) ABSTRACT

An improved system and method for controlling the temperature of a resistance heater in a heating, ventilation and air-conditioning ("HVAC") system is disclosed. The control circuit and method includes three separate thermostats per heater leg and are designed to trip at three, sequential pre-selected temperatures to address certain issues associated with prior art designs for thermal overload protection. One of the thermostats is of an automatically resettable type wherein the remaining two are of a "one-shot" design and will remain open until there is human intervention.

33 Claims, 3 Drawing Sheets

HVAC HEATER POWER AND CONTROL CIRCUIT

BACKGROUND OF THE INVENTION

The present invention relates to a heater power and control circuit for use in a heating, ventilation and air-conditioning ("HVAC") system. In particular, the present invention relates to an improved system and method for controlling the temperature of a resistance heater in an HVAC system.

Although thermal overload protection has been used for many years with HVAC resistance heaters to sense and control when the heater temperature exceeds a predetermined level, there is still room for improvement in the design and operation of such circuits. In particular, as will be explained further below, prior art designs for sensing and controlling the temperature of resistance heaters in HVAC systems may not address certain issues encountered in situations of thermal overload. Accordingly, it would be desirable to be able to provide an improved heater power and control circuit for use in an HVAC system. It would also be desirable to be able to provide an improved method for controlling the temperature of a resistance heater in an HVAC system.

BRIEF SUMMARY OF THE INVENTION

The present invention provides an improved circuit and method for controlling the temperature of a resistance heater in an HVAC system, which may be composed of one or more heater elements connected in parallel. The circuit comprises: (A) a power circuit including [i] a dual thermostat having a first and second thermostat in series with each other, [ii] a first switch coupled to a first contactor for controlling the operation of the switch, and [iii] a resistance heater element coupled in series between the dual thermostat and the switch, wherein the first thermostat cycles open and closed automatically and is set to trip at a first temperature $T_1$, and the second thermostat is a manual thermostat and is set to trip at a second temperature $T_2$, where $T_2$ is higher than $T_1$; and (B) a control circuit including [i] a third thermostat coupled in series with the first contactor wherein energizing and de-energizing the first contactor causes the first switch to close and open, respectively, and wherein the third thermostat is a manual thermostat and is set to trip at a third temperature $T_3$, where $T_3$ is higher than $T_2$, and wherein when the temperature exceeds $T_3$, the third thermostat trips, thereby de-energizing the first contactor, causing the first switch to open in the power circuit and preventing current from being supplied to one end of the resistance heater element. When the third thermostat trips, it also opens the circuits for any other heater elements connected in parallel and the blower motor that forces air over the heater elements. As a result of this design, continual oscillation in the opening and closing of the first thermostat as a result of oscillation in the temperature above and below $T_1$, but less than $T_3$, is prevented by said second thermostat having a trip temperature $T_2$ above $T_1$ but less than $T_3$. Further, the circuit operating the blower motor is controlled by a thermostat that controls all of the heater elements, instead of less than all of those elements.

BRIEF DESCRIPTION OF THE DRAWINGS

The objects and advantages of the invention will be apparent upon consideration of the following detailed description, taken in conjunction with the accompanying drawings, in which like-reference numerals refer to like-parts throughout, and in which.

DETAILED DESCRIPTION OF THE INVENTION

Figure 1A:
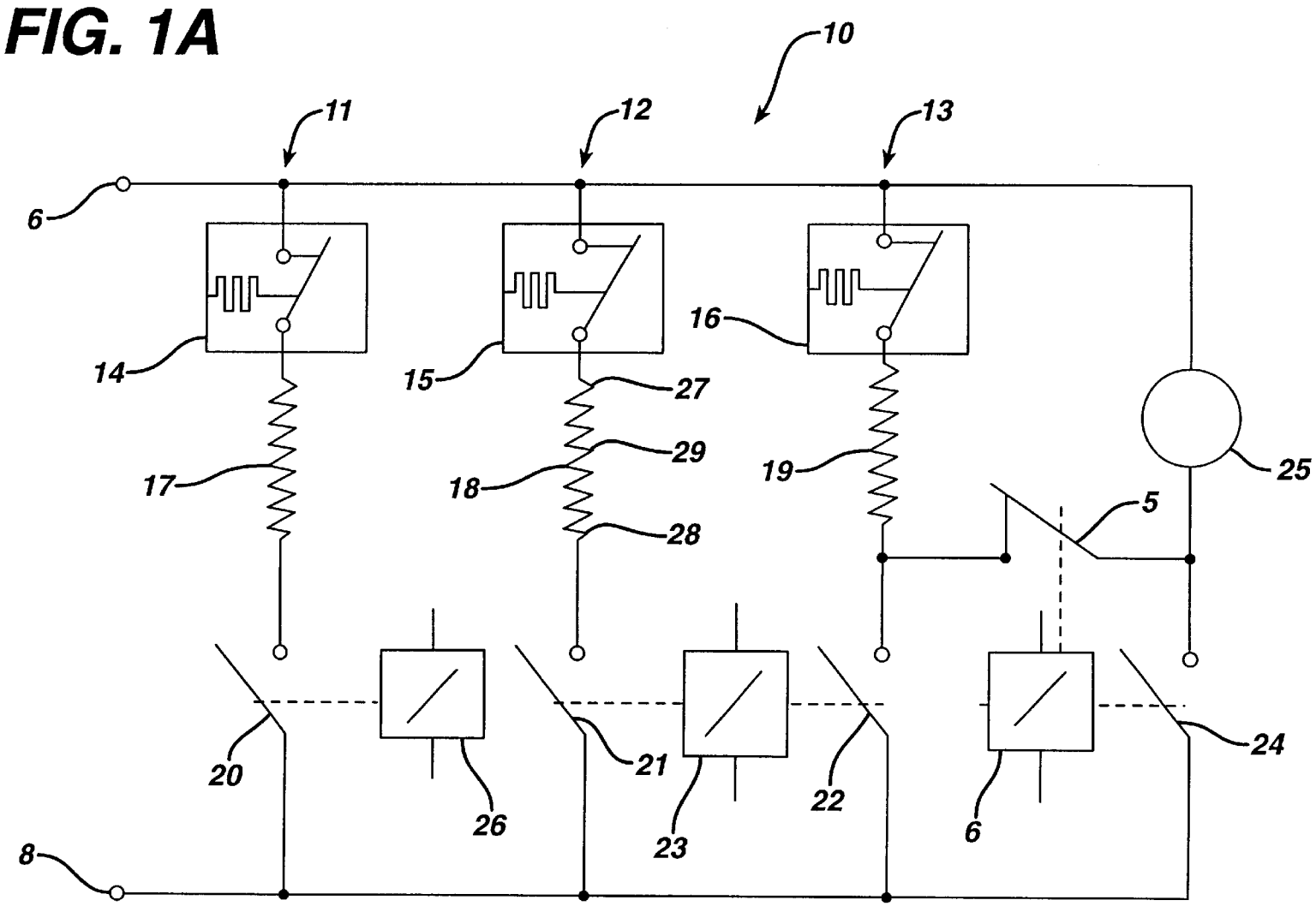
FIGS. 1A and 1B are electrical schematic diagrams of prior art circuits for controlling the temperature of a resistance heater in an HVAC system.
Figure 1B:
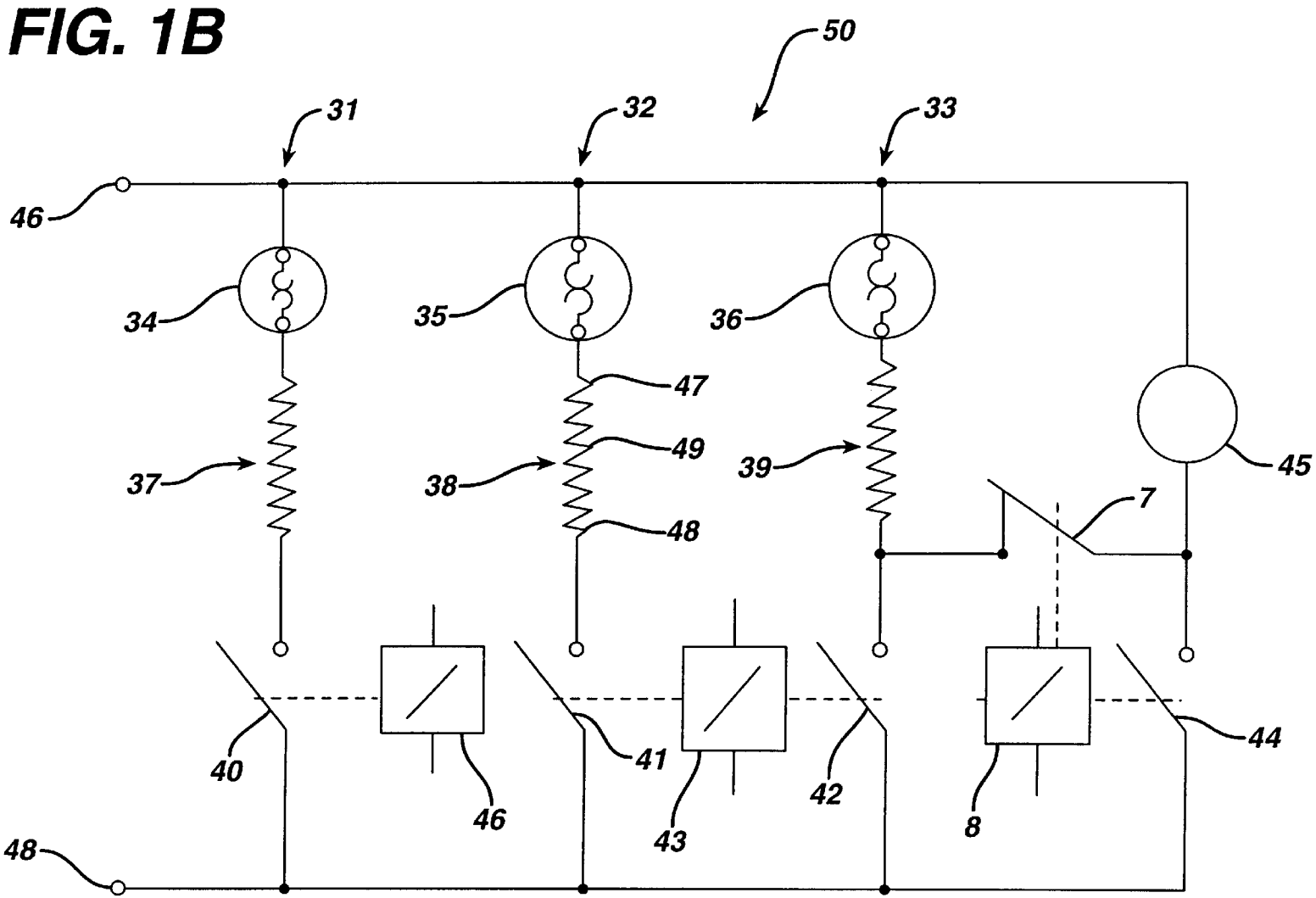

Thermal overload protection has been used for many years with HVAC resistance heaters to sense and control when the heater temperature exceeds a predetermined level. FIGS. 1A and 1B illustrate two such prior art techniques for providing overload protection.

In FIG. 1A, heater circuit 10 includes three heater legs 11, 12 and 13, all The present invention provides an improved circuit and method for controlling the temperature of a resistance heater in an HVAC system, which may be composed of one or more heater elements connected in parallel. The circuit comprises: (A) a power circuit including [i] a dual thermostat having a first and second thermostat in series with each other, [ii] a first switch coupled to a first contactor for controlling the operation of the switch, and [iii] a resistance heater element coupled in series between the dual thermostat and the switch, wherein the first thermostat cycles open and closed automatically and is set to trip at a first temperature $T_1$, and the second thermostat is a manual thermostat and is set to trip at a second temperature $T_2$, where $T_2$ is higher than $T_1$; and (B) a control circuit including [i] a third thermostat coupled in series with the first contactor wherein energizing and de-energizing the first contactor causes the first switch to close and open, respectively, and wherein the third thermostat is a manual thermostat and is set to trip at a third temperature $T_3$, where $T_3$ is higher than $T_2$, and wherein when the temperature exceeds $T_3$, the third thermostat trips, thereby de-energizing the first contactor, causing the first switch to open in the power circuit and preventing current from being supplied to one end of the resistance heater element. When the third thermostat trips, it also opens the circuits for any other heater elements connected in parallel and the blower motor that forces air over the heater elements. As a result of this design, continual oscillation in the opening and closing of the first thermostat as a result of oscillation in the temperature above and below $T_1$, but less than $T_3$, is prevented by said second thermostat having a trip temperature $T_2$ above $T_1$ but less than $T_3$. Further, the circuit operating the blower motor is controlled by a thermostat that controls all of the heater elements, instead of less than all of those elements coupled in parallel. Each heater leg (11, 12, 13) includes a thermostat (14, 15, 16), a resistance heater (17, 18, 19) and a switch (20, 21, 22), all coupled in series. Heater circuit 10 is connected to a power source 6, 8 (typically 120 to 240 volts A.C.) through circuit breakers (not shown). Switch 20 is controlled by single-pole contactor 26 that includes a solenoid that is activated and de-activated through a separate control circuit (not illustrated). Similarly, switches 21 and 22 are controlled by two-pole contactor 23 that includes a solenoid that is activated and de-activated through a separate control circuit (not illustrated). Contactors 26 and 23 are connected to the "heat" side of a thermostat (not illustrated). Blower motor 25, used to circulate hot air (or cold air when the HVAC unit is set to provide air conditioning), is turned on and off through, on the one hand, normally open switch 22 and normally closed switch 5 or, on the other hand, or normally open switch 24. Two-pole contactor 6, which is coupled to the "cool" side of a thermostat (not illustrated), controls switches 5 and 24. Thus, blower motor 25 is turned on either when switch 24 is closed via contactor 6 or switches 22 and 5 are closed via contactors 23 and 6, respectively. In the prior art circuit of FIG. 1A, the control circuit includes a manually resettable thermostat (i.e., a thermal cut-off) that is set to trip whenever the temperature adjacent heaters exceeds a pre-determined value $T_{CC}$. When it does, the contactor is de-energized and it opens its respective pair of switches, requiring a technician to manually "reset" or replace the thermostat so as to allow the solenoids in contactors 23 and 26 to be energized which, in turn, closes switches 20, 21 and 22. Thermostats 14, 15 and 16 in heater circuit 10 are automatically resettable thermostats and are set to trip whenever the temperature adjacent heater 17, 18 and 19, respectively, exceeds a pre-determined value $T_{PC}$. After tripping, when the temperature cools down below $T_{PC}$, the switches in thermostats 14, 15 and 16 automatically close allowing power to be supplied to their associated heaters. Typically, the tripping temperature $T_{PC}$ of thermostats 14, 15 and 16 in power circuit 10 are set to a temperature value lower than the tripping temperature $T_{CC}$ of the manually resettable thermostat in the control circuit associated with switches 20, 21 and 22. Accordingly, under conditions where the temperature adjacent a heater 17, 18 or 19 oscillates above and below $T_{PC}$ (but lower than $T_{CC}$), the switch in its associated thermostat 14, 15 or 16 will also oscillate open and closed, respectively.

In light of this design, when any of the switches in thermostat 14, 15 or 16 "sticks" closed, such "sticking" would allow current to be supplied to its respective heater 17, 18 or 19 even when the temperature exceeds $T_{PC}$. Under these conditions, circuit 10 is designed so that switches 20, 21 and 22 open when the temperature adjacent its associated heater exceeds temperature $T_{CC}$. In general, this will prevent both sides of a given heater from being energized (if its associated switch opens) and will prevent further operation of the heater even if the temperature cools back down to lower than $T_{CC}$ since contactors 23 and 26 are controlled by a manually resettable thermostat in the control circuit. However, under those conditions where a short circuit may develop in a portion of a heater (e.g., at point 29 between ends 27 and 28 of heater 18), the opening of its associated switch 21 will not necessarily prevent current from being supplied through at least a portion of heater 18. This is because with switch 21 open and point 29 of heater 18 shorted to ground, the portion of heater 18 between post 29 and end 27 and 28 will still be supplied with current through thermostat 15 if it is "stuck" closed. Accordingly, under this failure mode, the design of circuit 10 is such that temperatures in excess of $T_{CC}$ are not necessarily prevented by the combination of the use of two thermostats associated with each heater leg of circuit 10 and a corresponding control circuit.

A further aspect of the above design concerns the operation of blower motor 25. In particular, the purpose of blower motor 25 is to remove the heat generated by heaters 17, 18 and 19 when they are operating normally. However, because of the design, the same contactor 23 that cuts off power to heater 19 also turns off blower motor 25 as well. That action, however, becomes counterproductive if any of the remaining two heaters 17 and 18 remain in an "on" position generating heat while blower motor 25 has been turned "off." Similarly, if either of thermostat 14 or 15 is "stuck" closed and a portion of their respective heaters are shorted to ground, when associated switches 20, 21 and 22 open due to the temperature exceeding $T_{CC}$, blower motor 25 will be switched "off" even though a portion of a heater may still be generating heat. This results in a condition where heat is not being removed from the housing.

The prior art circuit 50 illustrated in FIG. 1B differs in design from that shown in FIG. 1A in two primary respects. Thermostats 34, 35 and 36 (i.e., thermal cut-offs), instead of being automatically resettable, are manually resettable so that if the temperature adjacent its respective heater 37, 38 or 39 exceeds a predetermined value $T_{PCB}$, the thermostat would need to be manually reset or replaced in order for its internal switch to be able to be closed once again and supply current to its respective heater. In addition, contactors 46 and 43, which are controlled by a separate control circuit (not shown), include an automatically resettable thermostat (instead of a manually resettable one as in connection with FIG. 1A) that is set to trip at a predetermined temperature value $T_{CCB}$. When it does, and the temperature cools down to less than $T_{CCB}$, switches 40, 41 and 42 are automatically closed through contactors 46 and 43. Typically, the tripping temperature $T_{CCB}$ of the automatically resettable thermostat in the control circuit is set to a temperature value lower than the tripping temperature $T_{PCB}$ of manually resettable thermostats 34, 35 and 36. Accordingly, under conditions where the temperature adjacent a heater oscillates above and below $T_{CCB}$ (but lower than $T_{PCB}$), switches 40, 41 and 42 (as well as the one present in the automatically resettable thermostat associated with the control circuit) will oscillate open and closed. As discussed above in connection with the prior art circuit of FIG. 1A, under conditions where a short circuit may develop in a portion of a heater (e.g., portion 49 of heater 38 between ends 47 and 48), the opening of the switch associated with thermostat 35 will not necessarily prevent current from being supplied to the portion of heater between points 48 and 49 through switch 41 when it is "stuck" closed (or when the switch present in the automatically resettable thermostat associated with the control circuit is "stuck" as well). Accordingly, the design of circuit 50 is also such that temperatures in excess of $T_{PCB}$ are not necessarily prevented by the combination of the use of two thermostats in connection with each heater leg of power circuit 50 and a corresponding control circuit. In addition, as discussed above in connection with the blower motor FIG. 1A, the design of FIG. 1B is such that under certain conditions blower motor 45 could be turned off through switch 42 even though one of the heaters (i.e., heater 37 or 38) is still generating heat resulting in a situation where the blower motor is not performing its intended function of removing heat from the heater housing.

Figure 2:
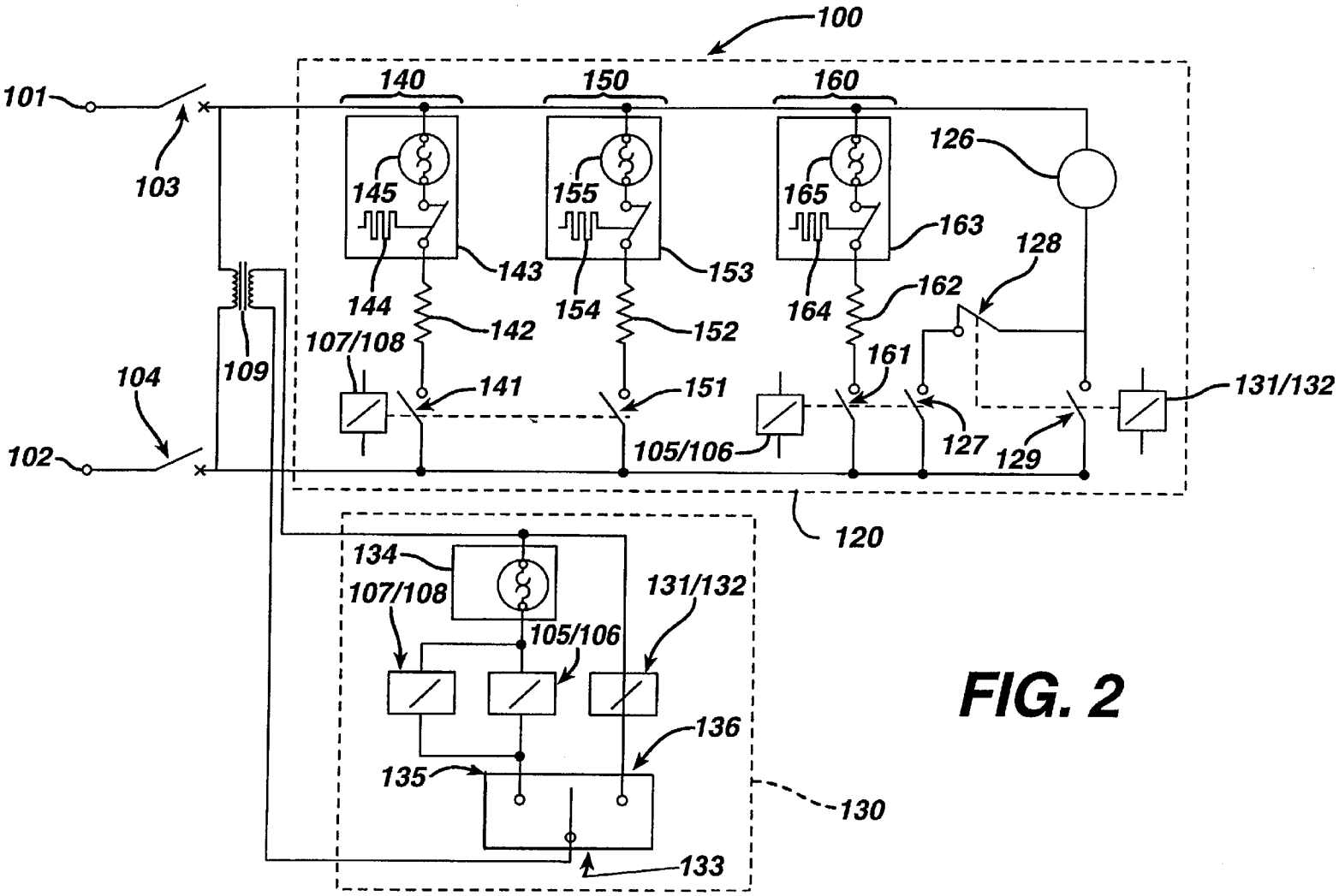
FIG. 2 is an electrical schematic diagram of a preferred embodiment of the HVAC heater power and control circuit in accordance with the present invention.

To address the issues discussed above, FIG. 2 illustrates a preferred embodiment of the HVAC heater power and control circuit of the present invention. As explained below, circuit 100 is designed to both supply electrical power to and control the operation of a resistance heater and blower motor in an HVAC system.

In particular, circuit 100 includes a power circuit portion 120 and a control circuit portion 130. The power circuit 120 consists of heater legs 140, 150, 160, blower motor 126 and an AC power supply 101, 102 through circuit breakers 103, 104, all arranged in parallel. Each of the heater legs has a switch (141, 151, 161), a heating element (142, 152, 162) and dual thermostats (143, 153, 163), all arranged in series. Each of the respective switches for each heater is in turn connected to two-pole contactors (i.e., contactor 105/106 to switch 161; and contactor 107/108 to switches 141 and 151). When the two-pole contactors are energized or de-energized, they will cause the switches to respectively close or open, thus controlling the supply of power to the heating elements. Initially, each switch is open so no power is supplied to the heating elements.

In the event of an unsafe operating temperature, power supplied to a respective heating element can be interrupted by either of the two associated dual thermostats 143, 153, 163. Each of the dual thermostats 143, 153, 163 have two independent, for example, bi-metal disks which basically operate as independent electrical switches. The first thermostat switch (144, 154, 164) is set to trip at a first temperature (e.g., $T_1$=145° F.) and will automatically cycle the heater on and off as the thermostat temperature drops below or rises above the first trip temperature. The second thermostat switch (145, 155, 165) is of a "one-shot" design and is set to trip at a second temperature (e.g., $T_2$=180° F.). It will remain open until there is human intervention (e.g., by manually resetting the thermostat, if it is the type that is manually resettable, or by replacing the component). Dual thermostats 143, 153, 163 are available from, for example, Therm-O-Disc, Inc. of Mansfield, Ohio (Model Type 75TF).

The aforementioned contactors 105/106 and 107/108 are controlled by a room thermostat in control circuit 130. The room thermostat 133 is connected in series to secondary of transformer 109 whose primary is arranged in parallel with all the elements of the power circuit. Room thermostat 133 has two settings "Heat" (side 135 of thermostat 133) and "Cool" (side 136 of thermostat 133) and will provide power to the two-pole contactors depending on said settings. When room thermostat 133 is set to "Heat" and reaches a certain temperature level, the two-pole contactors 105/106 and 107/108 will be energized and will close the switches for each of the heating elements, thus energizing the three heaters. In the control circuit 130, a thermostat 134 is connected in series with the two-pole contactors 105/106 and 107/108 and the heat side 135 of the room thermostat 133. Thermostat 134 (physically located adjacent the heater assembly) is of a "one-shot" design and is set to open at a third trip temperature (e.g., $T_3$=208° F.). It will remain open until there is human intervention (e.g., by manually resetting the thermostat, if it is the type that is manually resettable, or by replacing the component). When this third thermostat 134 causes a break in the circuit, power to the two-pole contactors 105/106 and 107/108 will be cut off causing the contactors to de-energize, thus opening the switches to the three heaters (142, 152, 162). Thermostat 134 is available from, for example, Therm-O-Disc, Inc. of Mansfield, Ohio (Model Type 60T with manual reset).

A blower motor 126 is also controlled by room thermostat 133. The motor can receive power through switches 127 and 128 or through switch 129 depending on the setting of room thermostat 133. Initially, switch 128 is closed while the other two switches are open. These latter switches are connected to two-pole contactors (switch 127 to contactor 105/106 and switch 129 to contactor 131/132) which are associated with the control circuit. More specifically, the two-pole contactor 105/106 is connected to the "Heat" side 135 of room thermostat 133 while the two-pole contractor 1311132 is connected to "Cool" side 136. When room thermostat 133 is set to the beat side and signals for more heat, the two-pole contractor 105/106 will be energized and thus close switch 127 and allow power to flow to blower motor 126. The motor will remain energized and continue to maintain air-flow as long as the thermostat control circuit keeps the switch 127 closed. This arrangement maintains the air-flow even if the temperature were to exceed the first and indeed the second trip-point of the dual thermostats (e.g., $T_1$=145° F. and $T_2$=180° F.). This is intended to reduce risk of rapid localized overheating. When in heating mode, blower motor 126 will not be de-energized until the third thermal overload temperature limit associated with thermostat 134 is exceeded (e.g., $T_3$=208° F.). When room thermostat 133 is switched to the "Cool" side 136, the two-pole contractor 131/132 will energize and thus open switch 128 and close switch 129. Thus, motor 126 will then receive power through the switch 129 to provide for cooling.

The thermal overload protection that is provided in connection with circuit 100 works as follows. Under normal operating conditions when room thermostat 133 is set to energize heaters 142, 152, 162, thermostats 143, 153 and 163 serve to control the current through the heaters and cycle automatically at a trip temperature $T_1$ (e.g., $T_1$=145° F.) associated with portions 144, 154 and 164 of thermostats 143, 153 and 163, respectively. Under those conditions where the temperature exceeds $T_2$ (e.g., $T_2$=180° F.), the other switch (i.e., 145, 155, 165) in thermostats 143, 153 and 163 is designed for single operation and, if tripped, will remain open until there is human intervention (e.g., by manually resetting the thermostat, if it is the type that is manually resettable, or by replacing the component). In addition, under those conditions where the temperature exceeds $T_3$ (e.g., $T_3$=208° F.), thermostat 134 in control circuit 130 will also trip, similarly requiring human intervention. When thermostat 134 trips, heater switches 141, 151 and 161 not only open, but so does switch 127 causing blower motor 126 to shut off as well. Accordingly, as a result of the design, blower motor 126 remains "on" until all three elements 142, 152 and 153 are switched "off." Unlike the prior art, manually resettable thermal protections both below and at the maximum limit temperature substantially reduce the likelihood that the contactor will cycle and wear excessively. Such excessive cycling and wear could result in certain circumstances in situations where one of the heaters could be still generating heat while the blower motor has been turned "off."

Thus, an improved heater power and control circuit for use in controlling the temperature of a resistance heater in an HVAC system has been disclosed. One skilled in the art will appreciate that the present invention can be practiced by other than the described embodiments, which are presented here for purposes of illustration and not of limitation, and that the present invention is limited only by the claims that follow.

What is claimed is:

1. A circuit for controlling the temperature of a resistance heater comprising:

a power circuit including a dual thermostat having a first and second thermostat in series with each other, a first switch coupled to a first contactor for controlling the operation of the switch, and a resistance heater coupled in series between the dual thermostat and the switch, wherein the first thermostat cycles open and closed automatically and is set to trip at a first temperature $T_1$ and the second thermostat is a manual thermostat and is set to trip at a second temperature $T_2$, where $T_2$ is higher than $T_1$; and a control circuit including a third thermostat coupled in series with the first contactor wherein energizing and de-energizing the first contactor causes the first switch to close and open, respectively, and wherein the third thermostat is a one-shot thermostat and is set to trip at a third temperature $T_3$, where $T_3$ is higher than $T_2$, and wherein when the temperature exceeds $T_3$, the third thermostat trips, thereby de-energizing the first contactor, causing the first switch to open in the power circuit and preventing current from being supplied to one end of the resistance heater, whereby continual oscillation in the opening and closing of the first thermostat as a result of oscillation in the temperature above and below $T_1$, but less than $T_3$, is prevented by said second thermostat having a trip temperature above $T_1$ but less than $T_3$.

2. The circuit of claim 1 wherein the resistance heater is used in a heating, ventilation and air conditioning system.

3. The circuit of claim 1 wherein a blower motor is coupled in parallel across the dual thermostat and resistance heater.

4. The circuit of claim 3 wherein the blower motor is not powered off until the temperature exceeds $T_3$.

5. The circuit of claim 1 wherein the first, second and third thermostats comprise bi-metal disc thermostats.

6. The circuit of claim 1 wherein the control circuit includes a transformer coupled in parallel across the power circuit.

7. The circuit of claim 6 further including a room thermostat coupled in series with the third thermostat and first contactor.

8. The circuit of claim 7 wherein the room thermostat includes a heat section and a cool section.

9. The circuit of claim 8 wherein the heat section is adapted to allow a user to activate the resistance heater and the cool section is adapted to allow the user to activate an air conditioner unit.

10. The circuit of claim 1 wherein the power circuit includes three resistance heaters coupled in parallel and each being controlled by a respective dual thermostat.

11. The circuit of claim 1 wherein the first temperature is about 140° C. to 160° C., the second temperature is about 170° C. to 190° C. and the third temperature $T_3$ is greater than $T_2$.

12. A circuit for controlling the temperature of a heater comprising:

a power circuit including a first thermostat means in series with a second thermostat means for providing thermal overload protection, a first switching means coupled to a first contactor means for controlling the operation of the first switching means, and heater means coupled in series between the first switching means and at least one of the first and second thermostat means, wherein the first thermostat means cycles open and closed automatically and is set to trip at a first temperature $T_1$ and the second thermostat means is a one-shot thermostat and is set to trip at a second temperature $T_2$, where $T_2$ is higher than $T_1$; and a control circuit including a third thermostat means coupled in series with the first contactor means wherein energizing and de-energizing the first contactor means causes the first switch to close and open, respectively, and wherein the third thermostat means is a one-shot thermostat and is set to trip at a third temperature $T_3$, where $T_3$ is higher than $T_2$, and wherein when the temperature exceeds $T_3$, the third thermostat trips, thereby de-energizing the first contactor means, causing the first switch means to open in the power circuit and preventing current from being supplied to one end of the heater means, whereby continual oscillation in the opening and closing of the first thermostat means as a result of oscillation in the temperature above and below $T_1$, but less than $T_3$, is prevented by said second thermostat means having a trip temperature above $T_1$ but less than $T_3$.

13. The circuit of claim 12 wherein the heater means is used in a heating, ventilation and air conditioning system.

14. The circuit of claim 12 wherein a blower motor is coupled in parallel across the first and second thermostat means and resistance heater.

15. The circuit of claim 14 wherein the blower motor is not powered off until the temperature exceeds $T_3$.

16. The circuit of claim 12 wherein the first, second and third thermostat means comprise bi-metal disc thermostats.

17. The circuit of claim 12 wherein the control circuit includes a transformer coupled in parallel across the power circuit.

18. The circuit of claim 17 further including a room thermostat coupled in series with the third thermostat means and first contactor means.

19. The circuit of claim 18 wherein the room thermostat includes a heat section and a cool section.

20. The circuit of claim 19 wherein the heat section is adapted to allow a user to activate the heater means and the cool section is adapted to allow the user to activate an air conditioner unit.

21. The circuit of claim 12 wherein the power circuit includes three heater means coupled in parallel and each being controlled by respective thermostat means.

22. The circuit of claim 12 wherein the first temperature is about 140° C. to 160° C., the second temperature is about 170° C. to 190° C. and the third temperature $T_3$ is greater than $T_2$.

23. A method for controlling the temperature of a resistance heater comprising:

providing in a power circuit a dual set of thermostats having a first and second thermostat in series with each other, a first switch coupled to a first contactor for controlling the operation of the switch, and a resistance heater coupled in series between the dual set of thermostats and the switch, wherein the first thermostat cycles open and closed automatically and is set to trip at a first temperature $T_1$ and the second thermostat is a one-shot thermostat and is set to trip at a second temperature $T_2$, where $T_2$ is higher than $T_1$; and providing in a control circuit a third thermostat coupled in series with the first contactor wherein energizing and de-energizing the first contactor causes the first switch to close and open, respectively, and wherein the third thermostat is a one-shot thermostat and is set to trip at a third temperature $T_3$, where $T_3$ is higher than $T_2$, and wherein when the temperature exceeds $T_3$, the third thermostat trips, thereby de-energizing the first contactor, causing the first switch to open in the power circuit and preventing current from being supplied to one end of the resistance heater, whereby continual oscillation in the opening and closing of the first thermostat as a result of oscillation in the temperature above and below $T_1$, but less than $T_3$, is prevented by said second thermostat having a trip temperature above $T_1$ but less than $T_3$.

24. The method of claim 23 wherein the resistance heater is used in a heating, ventilation and air conditioning system.

25. The method of claim 23 wherein a blower motor is coupled in parallel across the dual thermostat and resistance heater.

26. The method of claim 25 wherein the blower motor is not powered off until the temperature exceeds $T_3$.

27. The method of claim 23 wherein the first, second and third thermostats comprise bi-metal disc thermostat.

28. The method of claim 23 wherein the control circuit includes a transformer coupled in parallel across the power circuit.

29. The method of claim 28 further including a room thermostat coupled in series with the third thermostat and first contactor.

30. The method of claim 29 wherein the room thermostat includes a heat section and a cool section.

31. The method of claim 30 wherein the heat section is adapted to allow a user to activate the resistance heater and the cool section is adapted to allow the user to activate an air conditioner unit.

32. The method of claim 23 wherein the power circuit includes three resistance heaters coupled in parallel and each being controlled by a respective dual thermostat.

33. The method of claim 23 wherein the first temperature is about 140° C. to 160° C., the second temperature is about 170° C. to 190° C. and the third temperature $T_3$ is greater than $T_2$.

* * * * *